United States Patent [19]

Lentsch

[11] Patent Number: 4,951,837

[45] Date of Patent: Aug. 28, 1990

[54] DISPENSER FOR DISPOSABLE FUNNELS

[76] Inventor: Allen C. Lentsch, 14030 Haywood Path, Apple Valley, Minn. 55124

[21] Appl. No.: 420,645

[22] Filed: Oct. 11, 1989

Related U.S. Application Data

[63] Continuation of Ser. No. 199,760, May 27, 1988, abandoned.

[51] Int. Cl.[5] ..... B65H 1/00

[52] U.S. Cl. ..... 221/45; 221/61; 221/63

[58] Field of Search ..... 221/307, 310, 45, 61, 221/63, 312, 303, 312 R, 312 C, 33, 44; 285/901; 403/365

[56] References Cited

U.S. PATENT DOCUMENTS

| | | | |
|---|---|---|---|
| Re. 17,664 | 5/1930 | Barbieri | 221/63 |
| 1,762,948 | 6/1930 | Barbieri | 221/63 |
| 2,141,682 | 12/1938 | Carew | 221/44 |
| 2,203,494 | 6/1940 | Greenhill | 312/43 |
| 2,584,941 | 2/1952 | Taubert | 312/43 |
| 2,877,403 | 3/1959 | Bennett | 221/44 |
| 3,043,473 | 7/1962 | Katz | 221/63 |
| 3,069,048 | 12/1962 | Easton et al. | 221/45 |
| 3,568,884 | 3/1971 | Petricek | 221/307 |
| 3,581,934 | 6/1971 | Sciascia | 221/310 |
| 3,669,307 | 6/1972 | Pfund et al. | 221/310 |
| 4,126,248 | 11/1978 | House | 221/310 |
| 4,590,974 | 5/1986 | Mathews | 222/108 |
| 4,684,036 | 8/1987 | Brewer | 221/61 |
| 4,840,291 | 6/1989 | Merlin | 221/63 |

*Primary Examiner*—Kevin P. Shaver
*Assistant Examiner*—Steven Reiss
*Attorney, Agent, or Firm*—Robert C. Baker

[57] ABSTRACT

The wall-mountable disposable-funnel dispenser has a funnel feeder member and a cover member which frictionally fit together to provide a convenient, compact storage container for paper funnels. The funnel feeder member and cover member are constructed of shape-retaining molded plastic. The structure includes a wall-mounting bracket, knob-like projections on the inner rim of the cover member for accomplishing a friction fit to the feeder member, an arrangement of ribs on the interior of the funnel feeder member to facilitate easy movement of the funnels to the bottom end of the dispenser, and ribs at the lower end of the feeder member to temporarily hold the lowermost removable funnel of a nested stack of the same. The dispenser is easily mounted on a wall near working areas for convenient access to disposable funnels which can be individually withdrawn from the bottom of the dispenser.

18 Claims, 1 Drawing Sheet

DISPENSER FOR DISPOSABLE FUNNELS

This is a continuation of application Ser. No. 199,760, filed May 27, 1988, now abandoned.

BACKGROUND OF THE INVENTION

This invention relates to a wall-mountable dispenser for storing a stack of disposable funnels and allowing for individual funnel removal from the bottom end of the dispenser. The invention also relates to a composite product including disposable funnels in the dispenser.

One of the problems encountered in using funnels to direct the flow of liquids such as fuels, oils, paint, varnish, thinners or the like, is that the inside walls of the funnel often retain a thin film of the fluid passing through the funnel. When the funneling operation is completed this liquid film must then be promptly removed to eliminate dripping of the liquid from the funnel or contamination of the funnel for future use. This invention provides economical, disposable funnels in a convenient dispenser arrangement for household or industrial use. Disposable paper funnels can be economically manufactured by securely folding a sheet of paper into a hollow cone shape, outwardly rolling the upper edge to create a reinforced upper rim and trimming away the tip of the cone to create the lower open end of the funnel.

Another problem encountered in regard to funnels is that of storing the funnels when not in use It is desirable to store funnels away from dirt or other substances which might contaminate the funnel for future use, but their cone shape makes them bulky to store. This invention provides a compact storage container for maintaining a multitude of funnels in a clean condition. The container also functions as a dispenser and is easily mounted on a wall near a working area for convenient use of the funnels.

The dispenser is simple and economical to manufacture, and preferably consists of only two molded plastic units. These units are the cover member and the funnel feeder member. In the preferred embodiment, these members or units fit together in a frictional manner, with knob-like projections on the inner rim of the cover pressing against a reinforcing band on the exterior upper end of the feeder member. The simple unitary construction of the preferred feeder member includes an integral wall-mounting bracket. The connection of the bracket to the main wall of the feeder member preferably also functions as an abutment means for limiting movement of the cover over the feeder member.

SUMMARY OF THE INVENTION

The wall-mountable disposable-funnel dispenser of the invention comprises a cover member and a funnel feeder member. The feeder member has generally cylindrical housing wall which preferably fractionally decreases in interior diameter from the upper end to the lower end thereof. A plurality of spaced inwardly-projecting axially-parallel fins are united to the interior lower portion of the feeder member housing wall. The fins provide a holder and resting place for the rim of the lowermost funnel in a nested stack of funnels held for easy individual funnel removal and use. The housing wall preferably has a thickened reinforcing band integrally united to the exterior of the upper end thereof, preferably has exteriorly projecting abutment means proximate to the lower part of the reinforcing band, and a wall-mountable bracket united to the exterior thereof.

The cover member comprises a generally cylindrical cover wall closed at one end to form a top and open at the bottom end. In the most preferred embodiment, friction means project inwardly from the interior of the cover wall at a location proximate to the open bottom end. The open bottom end slides over the reinforcing band of the feeder member and abutts against the abutment means of the feeder member. Simultaneously the friction means of the cover member press against the reinforcing band of the feeder member to form a disengageable friction connection between the cover member and feeder member.

A nested stack of disposable funnels are held in the dispenser by inclined surfaces of the fins which project inwardly from the lower interior portion of the feeder member. The lowermost funnel in the stack can be individually withdrawn by slight downward hand pulling of the lowermost funnel over and off the inclined surfaces of the fins. This action deforms the rim of the funnel slightly as it passes over the blunted lower edges of the fins.

Many other features and advantages of the invention will become evident as this description proceeds.

DETAILED DESCRIPTION OF PREFERRED EMBODIMENT

Figure 1:
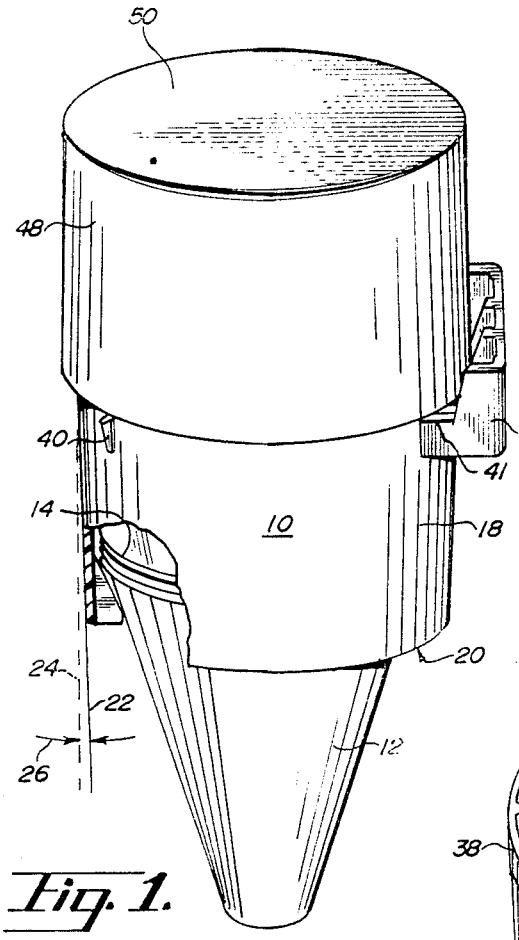
FIG. 1 is a schematic perspective view, partially broken away, illustrating the dispenser of the invention containing a nested stack of disposable funnels.
Figure 2:
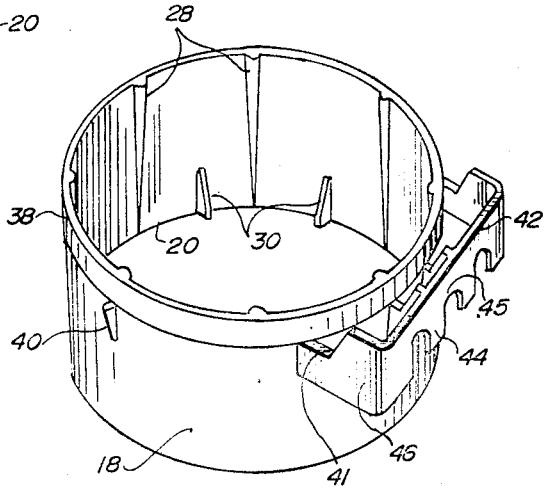
FIG. 2 is a schematic perspective view of the funnel feeder member, illustrating the wall-mounting bracket, exterior abutment means, interior hemi-conical tapering ribs, and the support fins on the interior surface.

Referring to FIG. 1, the funnel dispenser 10 contains a plurality of disposable frusto-conical paper funnels 12 in a nested stack formation (see the broken away portion) and in central axial orientation within the hollow vertical interior of the dispenser. The funnels ar individually dispensed by withdrawal from the open bottom end 20. The funnel dispenser is comprised of a hollow generally cylindrical funnel feeder member 18 and a hollow generally cylindrical cover member 48 having an open bottom end and a closed top 50 suitably formed by a flat disc-like wall. The disposable funnels 12 fit within the interior vertical bore-like space formed by the hollow interiors of the feeder member 18 and cover member 48. Also shown in FIGS. 1 and 2 is wall mounting bracket 42 and abutment means 40 and 41. Note that external abutment means 41 is formed by a portion of bracket 42 at the connection of an arm (formed by bridging 46) of the bracket to the outer cylindrical wall of the feeder member.

The two component parts of the dispenser, the feeder member 18 and the cover member 48, are preferably economically manufactured by using an unitary plastic molded construction for each. The funnels 12 have a rolled upper edge 14 which acts as a reinforcing rim at the top end of each funnel 12. The preferred disposable funnels are thin-walled and made of economical paper material. Paper sheet material may be converted to disposable funnels by spirally rolling the sheet into a hollow cone shape, outwardly rolling the upper edge to create the rolled upper rim edge 14, and trimming away the tip of the cone to create the lower open end of the funnel. Other materials for thin-walled disposable funnels may be employed, such as paper substitute materials or plastic. If desired, plastic disposable funnels of thin-walled or membrane-like character may be formed by injection molding or by using other pressure molding procedures. The term thin-walled as used in connection with disposable funnels refers to walls of paper thin character.

The feeder member 18 has a relatively thin but shape-retaining cylindrical housing wall of substantially uniform thickness except that a narrow band portion at its upper end may be thickened to provide a reinforcing band 38 (see FIG. 2) for the connection between the feeder member and a cover member. The thin cylindrical housing wall has sufficient body or thickness to retain its shape and not be crushable by hand. Generally the thin character will fall within the range of about 1 to 4 millimeters in thickness, with a thickness no greater than about 2 mm being preferable. The wall uniformly tapers very slightly (i.e., incrementally) from the top of the feeder member 18 to the open bottom end 20. Reference is made to FIG. 1 where solid line 22 extends below the open bottom end 20 of the cylindrical housing. This solid line represents the taper of the uniformly thick cylindrical housing wall of the feeder member. The taper is illustrated by comparing it to the vertical dash line 24. The angle of taper 26 formed by lines 22 and 24 may be in the range of 0.5 to 5 degrees and is preferrably within the range of about 1 to 3 degrees.

The taper of the cylindrical wall of the feeder member 18 contributes to easy removal of the feeder member from a mold. It also functions, especially in combination with a system of interiorly projecting ribs 28 and fins 30 (see FIG. 2), to maintain a vertical orientation for the nested stack of funnels 12 while facilitating movement of the funnels to the bottom end 20 of the dispenser with minimal frictional resistance. A plurality of the axially parallel, spaced hemi-conical tapering ribs 28 are united to the interior of feeder member 18. Each rib is of uniform radial inward projection (i.e., at the intersection of an imaginary horizontal plane through the feeder member at any of a variety of levels). Each rib uniformly tapers from top to bottom. Tapering ribs 28 complement the taper angle 26 of the feeder member 18; their taper angle is the reverse but equal in degrees to the taper of the interior surface of the cylindrical housing wall. Thus the inner edge of the taper forms a vertical line or surface. The ribs aid to vertically orient a nested stack of funnels and guide the movement of the funnels toward the bottom of the dispenser with minimal frictional resistance. They in essence create circumferentially spaced vertical surfaces defining a cylindrical chute on the interior of the feeder member 18, thereby minimizing contact of the funnels 12 with extensive portions of the interior of the cylindrical housing wall.

Figure 3:
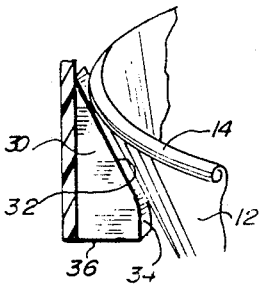
FIG. 3 is a fractional enlarged schematic fragmentary view of a fin and disposable paper funnel, illustrating the blunted interior lower portion of the fin, and illustrating the relationship of the slope of the fin to the conical taper of the funnel as well as the relationship of the rolled rim of the funnel to the contour of the fin.

Near the open bottom end 20 of the dispenser, the stack of nested funnels is retained or supported by holders formed by circumferentially-spaced vertically oriented fins 30. Fins 30 increase in inward projection from top to bottom to create a plurality of inclined planes which aid in maintaining the vertical orientation of the nested stack of funnels by approximating the conical angle of the funnels 12. The detail for these fins and their relationship to the funnels is best described by reference to FIG. 3. The rim 14 or rolled upper edge of the lowermost paper funnel 12 of a nested stack of the same rests against inclined surface 32 of fin 30. Withdrawal of the lowermost funnel by slight downward hand pulling causes the rolled upper edge 14 to slightly bend as it passes over the bottom portion of inclined surface 32 of the fin 30. The rolled upper edge 14 is thus deformed slightly as it passes by rounded or smoothed vertically blunted edge 34 of fin 30. The blunted edge provides a vertical fractional section which smooths the transition from deformation of the rim to return of the rim to its natural state after withdrawal from the dispenser. The next adjacent funnel and all nestingly stacked funnels above it are retained in the funnel dispenser 10. In the preferred embodiment the location of the fins are such that lower edge 36 of fin 30 is horizontal and lies in the same horizontal plane as the lower edge 20 of the feeder member 18.

The holding by the vertical fins 30 is somewhat frictional in character in that the resting rim 14 of the lowermost funnel presses against the inclined surface 32 under the weight of the nested funnel stack and undergoes a frictional rub against the inclined surface as the lowermost funnel is withdrawn from the dispenser. Several hundred paper funnels may be stacked in a nested formation inside the vertical cylindrical chute of the feeder member 18 (without the cover member in place over the feeder member) before the weight of the funnels exerts a downward pressure sufficient to force the lowermost funnel to fall out the open bottom end 20. In the preferred embodiment, the structural features of the feeder and cover member easily accommodate a nested stack of at least 50 paper funnels (and even at least 100 paper funnels) without the lowermost funnel falling out under the weight of the stack.

Also part of the unitary construction of the preferred feeder member 18 is wall mounting bracket 42. Wall mounting bracket 42 (see FIG. 2) has a wall-abutting vertical flat mounting plate 44. This plate lies in a plane which is parallel to the central vertical axis of the funnel dispenser 10 and perpendicular to the plane of a horizontal plane through the funnel dispenser. Plate 44 is spaced sufficiently away from the cylindrical wall of the feeder member 18 to permit the thickness of the cylindrical wall of the cover 48 to be interposed between the mounting plate 44 and the feeder member 18. The cylindrical portion of the feeder member 18 is united to the mounting plate 44 by bridging 46. The closest distance between plate 44 and the outer cylindrical wall (including thickened portion 38) of the feeder member 18 should lie in the range of 0.4 to 3.0 cm and is approximately 1 cm in the most preferred structures. Vertical notched recesses or channels 45 extend up from the lower edge of mounting plate 44. Preferably at least two notches or channels are employed. The channels suitably extend approximately one-half the height distance of the vertical mounting plate 4 and terminate in hemispherical shaped upper ends. The funnel dispenser 10 is securely mounted on a flat vertical surface such as a wall by sliding the channels in mounting plate 44 over one or more nail, bolt or screw heads previously appropriately set in the wall. To be recognized is that bridging 46 unites with the cylindrical housing wall of the feeder member at locations below the thickened band 38 at the upper end of the feeder member, and the bridging includes an abutment or stop portion 41 at its upper surface as well as a portion of greater height extending perpendicularly from plate 44.

Figure 4:
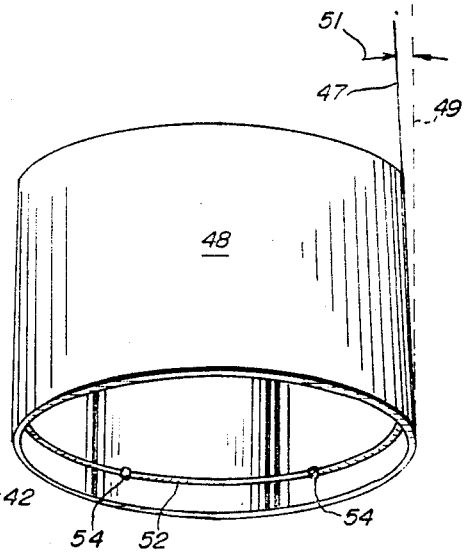
FIG. 4 is a perspective view of the cover member, illustrating a raised circular ring and raised hemispherical friction knobs united to the interior surface at a location proximate to the bottom end.

The nested stack of disposable funnels 12 are kept away from dirt and other contaminants by storage in the funnel dispenser with the cover member 48 in place over the top end of feeder member 18. The cover member 48 is preferably of unitary hollow generally cylindrical molded plastic construction. The cylindrical side cover wall is preferably of uniform thickness and may be in the range of 1–4 mm thick, although a thickness no greater than about 2 mm is most useful. The cylindrical side cover wall is of sufficient internal diameter to accommodate the diameter size of the funnels and the lower end of it is of a diameter to slide over reinforcing band 38 on the exterior of feeder member 18 so as to enclose the upper end of feeder member 18. The cylindrical cover wall fractionally increases in diameter from the closed top 50 (which is preferably flat) to the open bottom end. Illustratively solid line 47 (see FIG. 4) is a continuation of the slope of the cylindrical wall of the cover member, and dash line 49 is a line of vertical nature representing a pure cylinder configuration. The fractional increase in diameter of the cylindrical cover wall from top to bottom is thus illustrated by the angle 51 formed by solid line 47 and dash line 49. This angle is in the range of about 0.5 to 5 degrees, and is preferably between about 1 and 3 degrees. It is important for economical molding that the interior cylindrical surface of the cylindrical cover wall exhibit this taper. The top disc or plate wall of the cover is integral with the cylindrical cover wall.

A disengagable fit in the nature of a friction seal connection is formed between the cover member 48 and feeder member 18. Circumferentially spaced raised hemispherical knobs 54 are on the interior of the cylindrical cover wall at a location proximate to the bottom end. These knobs frictionally press against the reinforcing band 38 on the exterior of the feeder member 18 when the cover is in place. Knobs 54 may be located along a raised circular ring 52 on the interior of the cover member 48. Spaced knobs or projections are most preferred for a disengageable friction-like fit of the cover to the feeder member; however, a ring or frictional fit means may likewise be useful.

Abutment means 40 and 41 (see FIG. 2) serve as external stops to limit the movement of the cover over feeder member 18 and place the friction knobs 54 on the raised reinforcing band 38 of the feeder when the cover is in place. The axis of the cover member 48 is centered over the axis of the feeder member 18 when the abutment members are contacted by the lower edge of the cover member 48.

A variety of organic plastics materials may be employed in fabricating the dispenser. Polystyrene is especially useful and economical to use, but polyethylene or other plastics may be advantageously employed.

The invention may be embodied in other specific forms than that illustrated without departing from the spirit or essential characteristics thereof. The illustrated embodiment is therefore to be considered in all respects as illustrative and not restrictive, the scope of the invention being indicated by the appended claims; and all features which come within the meaning and range of equivalency of the claims are intended to be embraced thereby.

That which is claimed is:

1. A wall-mountable disposable-funnel dispenser constructed of shape-retaining molded plastic material, said dispenser consisting essentially of a feeder member and a cover member, a. said feeder member comprising a circumferentially continuous generally cylindrical housing wall having an open upper end and an open lower end and having a narrow reinforcing band on the exterior thereof at said upper end, said housing wall being of substantially uniform thickness except for said narrow reinforcing band, said housing wall having an interior fractionally decreasing in diameter from the open upper end to the open lower end, said housing wall having a plurality of spaced inwardly-projecting axially-parallel fins united to the interior thereof adjacent said lower end and increasing in inward projection from top to bottom such that each said fin forms an inclined plane of uniform slope at its interior edge the top end of said fins merging with said interior of said housing wall, each said fin having no inward projection greater than the bottom end of said slope and having a blunted vertical inward edge at the bottom end of said slope, each said fin having a lower edge which lies in substantially the same plane as said open lower end of said feeder member, said fins being oriented to receive the rim of a disposable funnel in resting condition thereupon, said fins being the sole inwardly directed structure at said open lower end of said housing wall for supporting a stack of disposable funnels and the sole inwardly directed structure contacted by a disposable funnel withdrawn through said open lower end by hand pulling of the same from said open lower end, said housing wall additionally carrying wall-mountable bracket means on the exterior surface thereof, b. said cover member consisting essentially of a generally cylindrical cover wall of substantially uniform thickness and having a closed top end and an open bottom end, said cover wall at the open bottom end thereof having a sufficient internal diameter to slide over the exterior of the reinforcing band at the upper end of said housing wall of said feeder member in a non-interlocking friction fit relationship for convenient slideable disengagement, and c. on one of said members, a plurality of circumferentially-spaced abutment means for terminating the extent of the slide of the bottom end of the cover wall over the upper end of the feeder member housing wall, said cover member being slideably removable for placing a stack of funnels in said feeder member through said open upper end of said feeder member without removing said feeder member from a wall mounted condition.

2. The dispenser of claim 1 wherein a plurality of spaced inwardly-projecting axially-parallel hemi-conical axially-tapering ribs are united to the interior of said housing wall, the greatest projection of said ribs being at the upper end thereof, the inner edge of said ribs defining a cylindrical chute within said feeder member.

3. The dispenser of claim 1 wherein a plurality of raised hemispherical friction knobs are circumferentially spaced along the interior of said cover wall proximate to said bottom end thereof, the exterior of the reinforcing band at the upper end of said housing wall having no recess for receiving said friction knobs.

4. The dispenser of claim 1 wherein each said fin is oriented to both receive the rim of a disposable funnel when the funnel is being stored and deform the rim when the funnel is withdrawn, and wherein the blunted inward edge of each said fin smooths the transition from said deformation of said rim to the return to its natural after withdrawal from the dispenser.

5. The dispenser of claim 1 wherein the blunted inward edge of said fins is substantially perpendicular to the lower edge of said fins.

6. A wall-mountable disposable-funnel dispenser constructed of shape-retaining molded plastic material comprising:

a. an open-ended hollow feeder member having a generally cylindrical housing wall fractionally decreasing in interior diameter from the open upper end to the open lower end thereof, said housing wall having a plurality of spaced inwardly-projecting axially-parallel sloped fins united to the interior lower portion thereof on which fins the rim of a funnel may rest, said fins being the sole inwardly directed structure contacted by a disposable funnel withdrawn through the open lower end of said feeder member, said fins increasing in inward projection from top to bottom such that each said fin forms an inclined plane of uniform slope at its interior edge, each said fin having no inward projection greater than the bottom end of said slope and having a blunted vertical inward edge at the bottom end of said slope, each said fin having a lower edge which lies in substantially the same plane as said lower end of said feeder member, said housing wall having a thickened reinforcing band integrally united to the exterior of the upper end thereof, having a plurality of circumferentially-spaced exteriorly projecting abutment members proximate to the lower part of said reinforcing band, and having wall mountable bracket means united to the exterior thereof; and b. a unitary hollow cover member consisting essentially of a generally cylindrical cover wall closed at one end to form a top, said cover wall having an open bottom end and having friction means projecting inwardly from the interior thereof proximate to said open bottom end, said open bottom end having sufficient internal diameter to slide over said reinforcing band of said feeder member into abutment against said abutment members of said feeder member while simultaneously effectively placing said friction means in pressing condition against said reinforcing band to form a disengageable non-interlocking friction connection between said cover member and said feeder member, said cover member being slideably removable for placing a stack of funnels in said feeder member through said open upper end of said feeder member without removing said feeder member from a wall mounted condition.

7. The dispenser of claim 6 wherein said housing wall is of substantially uniform thickness in those portions apart from said reinforcing band.

8. The dispenser of claim 6 wherein a plurality of spaced inwardly-projecting axially-parallel tapering ribs are united to the interior of said cylindrical housing wall, the inward projection of said ribs being greatest at the upper end of said housing wall and decreasing to merge with said housing wall at the lower end of said ribs.

9. The dispenser of claim 6 wherein said friction means of said cover member comprises knobs.

10. The dispenser of claim 6 wherein each said fin is oriented to both receive the rim of a disposable funnel when the funnel is being stored and deform the rim when the funnel is withdrawn, and wherein the blunted inward edge of each said fin smooths the transition from the deformation of said rim to the return to its natural state after withdrawal from the dispenser.

11. The dispenser of claim 6 wherein the blunted inward edge of said fins is substantially perpendicular to the lower edge of said fins.

12. A wall-mountable funnel dispenser constructed of shape-retaining molded plastic material comprising:

a. an open-ended hollow feeder member having a generally cylindrical housing wall fractionally decreasing in interior diameter from the upper end to the lower end thereof, the interior of said housing wall having thereon a plurality of spaced inwardly-projecting axially-parallel hemi-conical ribs uniformly tapered from the upper end thereof toward the lower end thereof, said housing wall having a plurality of spaced inwardly-projecting axially-parallel fins united to the interior lower portion thereof and increasing in inward projection from top to bottom to create a plurality of inclined planes on which the rim of a funnel may be rested, said inward projection of said fins being blunted at the lower end thereof, said feeder member having a thickened reinforcing band united to the exterior of the upper end of said housing wall, said feeder member having abutment means proximate to the lowermost part of said reinforcing band, and a wall-mounting bracket united to the exterior of said feeder member proximate to said lowermost part of said reinforcing band; and b. a unitary, hollow, cover member having a generally cylindrical cover wall of substantially uniform thickness, a closed top and an open bottom end, raised hemispherical friction knobs spaced circumferentially along the interior of said cover wall proximate to said bottom end, said bottom end portion of said cover wall having sufficient internal diameter to slide over and enclose the reinforcing band of said feeder member and place said raised hemispherical friction knobs in pressing condition against said reinforcing band to form a disengageable friction connection between said cover member and said feeder member, said abutment means preventing said feeder member from being telescoped into said cover member.

13. The dispenser of claim 12 wherein at least one of said abutment means comprises the structure connecting said bracket to the exterior of said feeder member.

14. The dispenser of claim 12 wherein said raised hemispherical friction knobs are circumferentially spaced along a raised circular ring united to the interior of said cover wall proximate to said bottom end.

15. A wall-mountable funnel dispenser and disposable funnel assembly comprising:

a. an open hollow funnel feeder member formed of shape-retaining molded plastic and having a generally cylindrical housing wall and a narrow exterior reinforcing band at the upper end thereof, said housing wall being of substantially uniform thickness except for said narrow reinforcing band, the interior of said housing wall decreasing in diameter from the open upper end to the open lower end, said housing wall having a plurality of circumferentially spaced inwardly-projecting axially-parallel fins united to the interior lower portion thereof, said fins having an inward edge merged at its upper end with the interior of said housing wall, said fins forming a slope of substantially uniform increase in inward projection from top to bottom and terminating at the bottom in a blunted vertical edge, the lower end of said fins lying in substantially the same plane as the bottom end of said feeder member, said fins being the sole inwardly directed structure at said open lower end of said housing wall, and a wall-mounting bracket united to the exterior of said housing wall at a location on the exterior of said housing wall proximate to the lower edge of said reinforcing band;

b. a unitary, hollow, cover member having a generally cylindrical cover wall, a closed flat top and an open bottom end, said cover member fractionally increasing in diameter from said closed flat top to said open bottom end, said bottom end of said cover member having sufficient internal diameter to enclose the exterior reinforcing band at the upper end of said feeder member in a non-interlocking friction relationship, said cover member being slideably removable for placing a re-fill stack of funnels in said feeder member through the open upper end of said feeder member without removing said feeder member from a wall mounted condition; and c. a nested stack of generally frusto-conical disposable funnels, said funnels having an upper outwardly projecting rim, with the rim of the lowermost funnel of said stack in resting condition on said fins but deformable sufficiently on withdrawal of said lowermost funnel from said stack to slide downwardly over said fins.

16. The dispenser of claim 15 wherein each said fin is oriented to both receive the rim of a disposable funnel when the funnel is being stored and deform the rim when the funnel is withdrawn, and wherein the blunted vertical edge of each said fin smooths the transition from said deformation of said fin to the return to its natural state after withdrawal from the dispenser.

17. The dispenser of claim 15 wherein the blunted vertical edge of said fins is substantially perpendicular to the lower end of said fins.

18. A wall-mountable disposable-funnel dispenser constructed of shape-retaining molded plastic material comprising:

a. an open-ended hollow feeder member having a generally cylindrical housing wall fractionally decreasing in interior diameter from the upper end to the lower end thereof, said housing wall having a plurality of spaced inwardly-projecting axially-parallel fins united to the interior lower portion thereof on which fins the rim of a funnel may rest, said housing wall having a plurality of spaced inwardly-projecting axially-parallel tapering ribs united to the interior thereof, the inward projection of said ribs being greatest at the upper end of said housing wall and decreasing to merge with said housing wall at the lower end of said ribs, said housing wall having a thickened reinforcing band integrally united to the exterior of the upper end thereof, having exteriorly projecting abutment means proximate to the lower part of said reinforcing band, and having wall mountable bracket means united to the exterior thereof; and b. a unitary hollow cover member consisting essentially of a generally cylindrical cover wall closed at one end to form a top, said cover wall having an open bottom end and having friction means projecting inwardly from the interior thereof proximate to said open bottom end, said open bottom end having sufficient internal diameter to slide over said reinforcing band of said feeder member into abutment against said abutment means of said feeder member while simultaneously effectively placing said friction means in pressing condition against said reinforcing band to form a disengageable friction connection between said cover member and said feeder member.

* * * * *